US008579738B2

(12) United States Patent
Yu

(10) Patent No.: US 8,579,738 B2
(45) Date of Patent: Nov. 12, 2013

(54) RACKET WITH REPLACEABLE GRIP SLEEVE

(75) Inventor: Kuo-Pin Yu, Taichung (TW)

(73) Assignee: Yuan Min An Enterprise Co., Ltd., Taichung (TW)

( * ) Notice: Subject to any disclaimer, the term of this patent is extended or adjusted under 35 U.S.C. 154(b) by 25 days.

(21) Appl. No.: 13/469,408

(22) Filed: May 11, 2012

(65) Prior Publication Data

US 2012/0289368 A1 Nov. 15, 2012

(30) Foreign Application Priority Data

May 11, 2011 (CN) ..... 2011 2 0152225 U

(51) Int. Cl.
*A63B 49/08* (2006.01)

(52) U.S. Cl.
USPC ..... 473/549

(58) Field of Classification Search
USPC ..... 473/549, 551, 552
See application file for complete search history.

(56) References Cited

U.S. PATENT DOCUMENTS

| | | | | | |
|---|---|---|---|---|---|
| 3,845,954 | A * | 11/1974 | Case | ..... | 473/549 |
| 3,931,968 | A * | 1/1976 | Hedberg | ..... | 473/552 |
| 4,641,838 | A * | 2/1987 | Gabrielidis | ..... | 473/552 |
| 5,516,101 | A * | 5/1996 | Peng | ..... | 473/523 |
| 5,524,879 | A * | 6/1996 | Lyle | ..... | 473/552 |
| 5,671,926 | A * | 9/1997 | Hagey | ..... | 473/549 |
| 6,017,283 | A * | 1/2000 | Hagey | ..... | 473/551 |
| 6,033,325 | A * | 3/2000 | Hong | ..... | 473/552 |
| 6,213,902 | B1 * | 4/2001 | Hagey et al. | ..... | 473/551 |
| 6,254,501 | B1 * | 7/2001 | Chang | ..... | 473/545 |
| 8,016,702 | B2 * | 9/2011 | Hagey | ..... | 473/551 |
| 2012/0184403 | A1 * | 7/2012 | Loreau | ..... | 473/538 |
| 2012/0289368 | A1 * | 11/2012 | Yu | ..... | 473/549 |

* cited by examiner

*Primary Examiner* — Raleigh W Chiu
(74) *Attorney, Agent, or Firm* — Muncy, Geissler, Olds & Lowe, PLLC

(57) ABSTRACT

A racket includes a main body, a replaceable grip sleeve, a nut and a bolt. The main body has a frame, a handle having at least one hole, and a bridge connected between the frame and the handle. The replaceable grip sleeve is sleeved onto the handle and provided with at least one through hole aimed at the hole of the handle. The bolt is inserted through the through hole of the replaceable grip sleeve and screwingly engaged with the nut disposed in the hole of the handle. The user can replace the replaceable grip sleeve of a predetermined size to meet his/her need.

9 Claims, 6 Drawing Sheets

RACKET WITH REPLACEABLE GRIP SLEEVE

BACKGROUND OF THE INVENTION

1. Field of the Invention

The present invention relates generally to sports equipments and more particularly, to a racket having a replaceable grip sleeve.

2. Description of the Related Art

Conventionally, a general racket, such as tennis racket or badminton racket, has, after it is made, fixed characteristics including, but not limited to, the size of the grip and the overall weight, such that a user can always choose a racket having specific characteristics that meet his/her need. However, if a user buys a racket with a big grip or a small grip and the undesired racket can not be returned or exchanged because it has been used for a certain period of time, the user may have to buy a new racket, causing increase of the user's economic burden. For a kid with a palm becoming larger and larger from time to time in a growth and development phrase, if it is needed to annually change a new racket having a grip of different size, the expense spent on the new rackets would be high.

In recent years, global warning has become worse gradually and natural resources have been increasingly consumed; therefore, resource separation, recycling and reuse and choosing a product having a low environmental impact are worldwide trend. For a conventional racket, if the frame of the racket becomes worn or broken or the grip is not fit for the user's palm, the usual way that the user may take is to discard the old racket and buy a new one. For kids in the growth and development phrase, this problem can be extensively seen. As a result, a considerable amount of rackets are discarded annually, causing the resource wasting problem and garbage handling problem. Therefore, how to enhance the reusability of racket so as to minimize the environmental impact due to the discarded rackets is always the topic of continued research and development in racket manufacturing industry.

Further, a conventional racket, e.g. a tennis racket, generally comprises a frame, a bridge extending from the frame, and a grip provided at the distal end of the bridge. When the ball-hitting surface of the racket hits a ball, the shock wave caused by hitting balls will be directly transmitted to the user's arm through, in succession the frame, the bridge and the grip sequent, such that the more the time that the user uses the racket to hit balls the higher the possibility that the user's arm gets a sports injury. Therefore, how to increase the shock-absorbing effect of the racket is also an issue to be worked out in the field of racket industry.

SUMMARY OF THE INVENTION

The present invention has been accomplished in view of the above-noted circumstances. It is therefore one object of the present invention to provide a racket having a replaceable grip sleeve, which can ease the user's economic burden.

Another object of the present invention is to provide a racket having a replaceable grip sleeve, which can enhance the reusability of the racket so as to reduce the impact on environment.

Still another object of the present invention is to provide a racket having a replaceable grip sleeve, which can enhance the shock-absorbing effect of the racket.

To achieve the above-mentioned objects, a racket having a replaceable grip sleeve provided by the present invention comprises a main body, a replaceable grip sleeve, a nut and a bolt. The main body has a frame, a handle, a bridge connected between the frame and the handle, and a hole at the handle. The replaceable grip sleeve is sleeved onto the handle of the main body and provided with at least one through hole aimed at the hole of the handle. The nut has at least a part that is received in the hole of the handle. The bolt has a shank inserted through the through hole of the replaceable grip sleeve and screwingly engaged with the nut, and a head located at an end of the shank and abutted against an outer periphery of the replaceable grip sleeve. By means of the aforesaid design, the replaceable grip sleeve can be conveniently mounted to and detached from the handle and the user can replace a different grip sleeve of a predetermined size on the handle so as to change the overall size of the grip of the racket.

Because the replaceable grip sleeve of the racket of the present invention can be replaced with a new one having a different size or material according to the actual need to prevent the whole racket from discard due to the fact that the grip is not applicable to the user, the reusability of the racket can be enhanced, the user's economic burden can be eased and the impact on environment can be reduced. Further, by means of changing a replaceable grip sleeve of different material, a different shock-absorbing effect of the racket can be provided. Furthermore, in order to provide a good shock-absorbing effect to prevent the user's arm from sports injury, a cushion may be further provided between the replaceable grip sleeve and the handle so as to minimize the magnitude of the impact shock wave that is transmitted to the user's arm.

Further scope of applicability of the present invention will become apparent from the detailed description given hereinafter.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
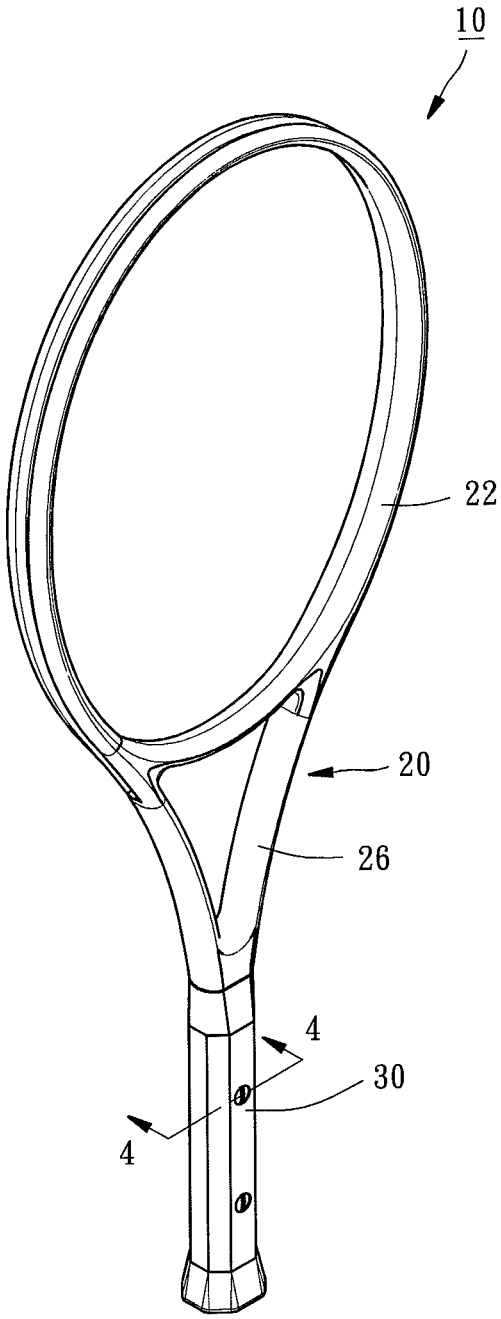
FIG. 1 is a perspective view of a racket according to a first preferred embodiment of the present invention.
Figure 2:
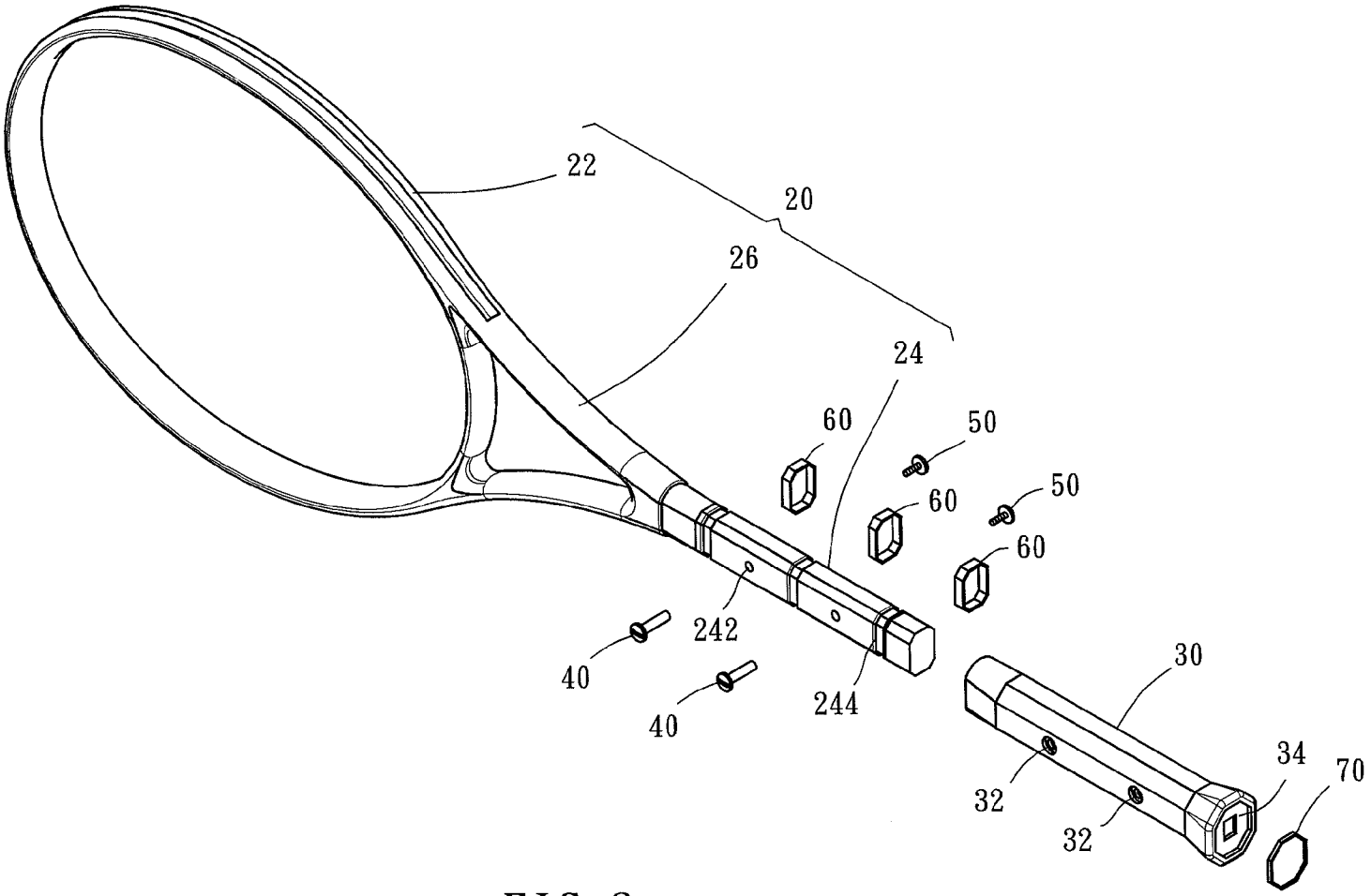
FIG. 2 is an exploded view of the racket according to the first preferred embodiment of the present invention.

As shown in FIGS. 1-2, a racket, which is provided according to a first preferred embodiment of the present invention and denoted by reference numeral 10, is exemplified, but not limited to, by a tennis racket, which comprises mainly a main body 20, a replaceable grip sleeve 30, two nuts 40 and two bolts 50.

The main body 20 includes a frame 22, a handle 24, a bridge 26 connected between the frame 22 and the handle 24, and two holes located at the handle 24. In this embodiment, the holes are realized as through holes 242 penetrating through the handle 24. The main body 20 is made from a composite material, such as fiber reinforced resin. For the fiber used in the composite material, carbon fiber, glass fiber, boron fiber or Kevlar fiber can be used. For the resin used in the composite material, thermoplastic resin or thermosetting resin can be used.

The replaceable grip sleeve 30 has four through holes 32 which are aimed at the two ends of the two through holes 242 of the handle 24 respectively. The replaceable grip sleeve 30 is made from a same composite material from which the main body 20 is made or a thermoplastic polyurethane by injection molding.

Figure 3:
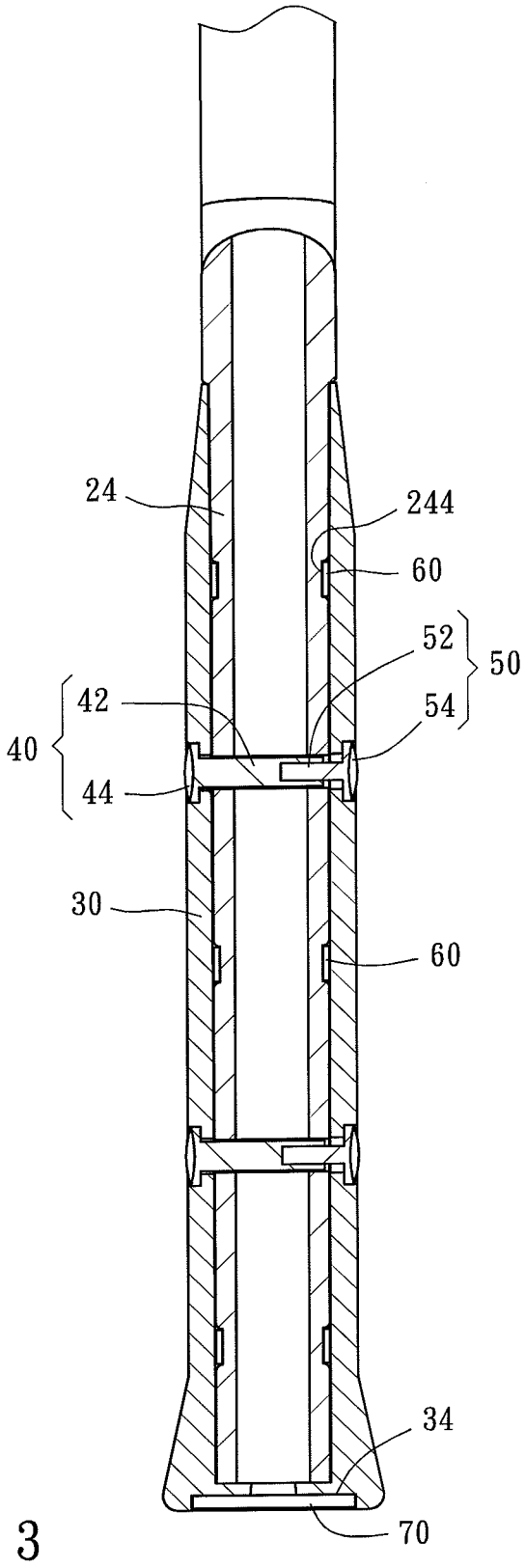
FIG. 3 is a sectional view of a part of the racket according to the first preferred embodiment of the present invention.
Figure 4:
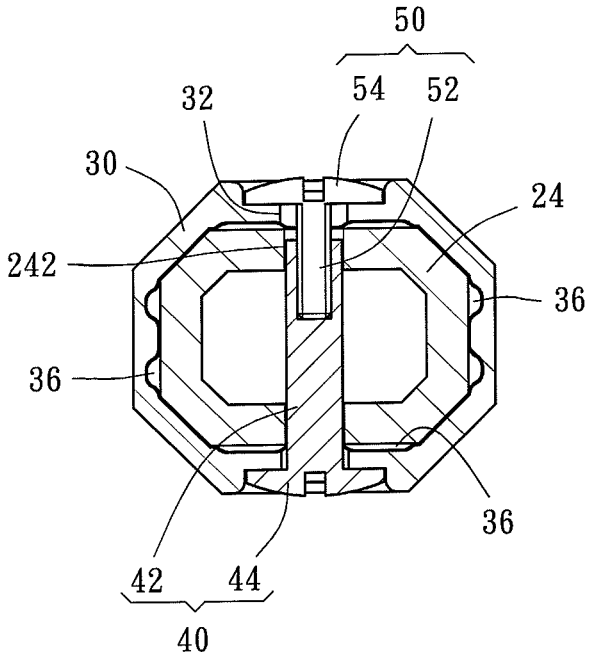
FIG. 4 is a sectional view taken along line 4-4 of FIG. 1.

FIG. 3 is a sectional view showing the handle and the replaceable grip sleeve of the racket according to the first preferred embodiment of the present invention. As shown in FIG. 3, the grip sleeve 30 is directly sleeved onto the handle 24 and fastened with the handle 24 by the screwingly engaged nuts 40 and bolts 50. In this preferred embodiment, a body 42 of the nut 40 is inserted through the through hole 242 of the handle 24. Specifically speaking, the shank 52 of the bolt 50 is inserted through the through hole 32 of the grip sleeve 30 and the through hole 242 of the handle 24 and screwingly engaged with the body 42 of the nut 40, which is also inserted through the through hole 32 of the grip sleeve 30 and the through hole 242 of the handle 24, and the head 54 of the bolt 50 and the head 44 of the nut 40 are abutted against the outer periphery of the grip sleeve 30. On the inner periphery of the grip sleeve 30 a plurality of non-contact portions 36 for reducing the overall weight of the grip sleeve 30 are provided and not in contact with the handle 24 after the grip sleeve 30 is sleeved onto the handle 24, as shown in FIG. 4. It will be appreciated that the non-contact portions 36 can be eliminated if the overall weight of the racket is not an issue to be addressed. Since the nut 40 and the bolt 50 can be conveniently engaged with or disengaged from each other according to the user's need, the user can replace a different grip sleeve on the handle 24 to make a specific grip having a predetermined size. On the bottom end of the grip sleeve 30 a recess 36 is provided for accommodation of a cover plate 70.

In light of the above, the replaceable grip sleeve 30 of the racket 10 of the present invention can be replaced with a new one having a different size or material subject to the actual need. For example, when kids grows up into teenagers, the main body 20 can be cooperated with a new grip sleeve of a bigger size to prevent the whole racket from discard due to unfitness of the grip, thereby enhancing the reusability of the racket, easing the economic burden of the user and reducing the environmental impact.

If the grip sleeve 30 and the handle 24 are made from different materials, the grip composed of the grip sleeve 30 and the handle 24 can provide a good shock-absorbing effect because the shock wave that is generated from the frame when the racket hits a ball and transmitted to the grip sleeve 30 through the handle 24 will decay due to the fact that the transmitting speed of the shock wave varies from substance to substance. Even if the grip sleeve 30 and the handle 24 are made from a same material, the magnitude of shock wave will be deteriorated when the shock wave travels through the interface between the grip sleeve 30 and the handle 24.

Further, as shown in FIG. 2, in order to provide a better shock-absorbing effect, three annular cushions 60, which are made from resilient plastic or rubber, such as thermoplastic rubber, polyurethane and polyether block amide (PEBA), are disposed between the handle 24 and the grip sleeve 30, and more specifically, received in three grooves 244 of the handle 24 respectively. In this way, the shock wave will be further absorbed by the cushions 60 and transmitted less to the user's arm, such that the possibility of the user's arm injury can be minimized.

Figure 5:
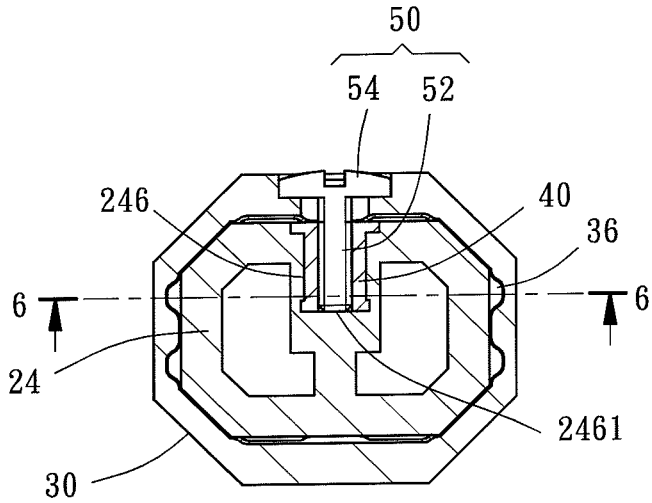
FIG. 5 is a sectional view of a part of a racket according to a second preferred embodiment of the present invention.
Figure 6:
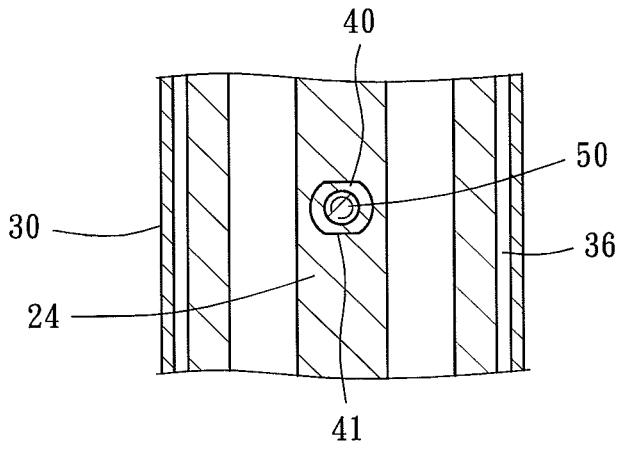
FIG. 6 is a sectional view taken along line 6-6 of FIG. 5.

In practical manufacturing, the hole of the handle can be configured in an alternate form other than the configuration of through hole shown in the first preferred embodiment. For example, as shown in FIG. 5 which is a sectional view of the racket provided by a second preferred embodiment of the present invention, the hole of the handle 24 is realized as a blind hole 246 having a bottom 2461. In addition, the outer periphery of the nut 40 is provided with two planar surfaces 41 as shown in FIG. 6. In fact, as long as the radial crosssection of the nut has a non-circle shape, the nut 40 won't be turned relative to the handle 24 upon receiving a large torque thereon.

Figure 7:
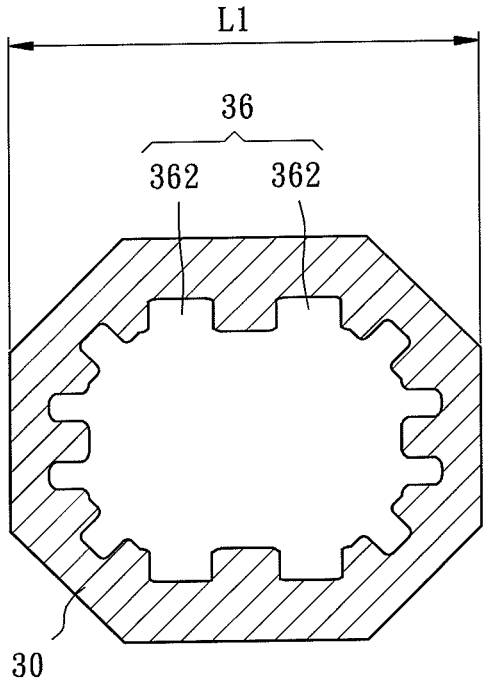
FIG. 7 is a sectional view of a replaceable grip sleeve of a racket according to a third preferred embodiment of the present invention.
Figure 8:
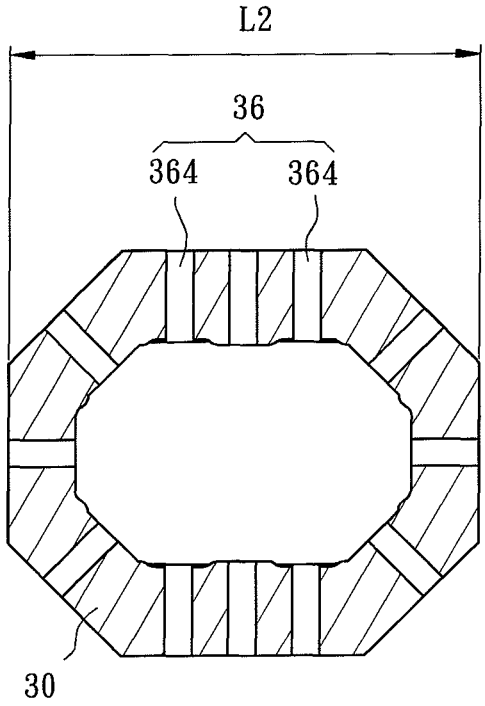
FIG. 8 is a sectional view of a replaceable grip sleeve of a racket according to a fourth preferred embodiment of the present invention.

Besides, the shape and configuration of the non-contact portion 36 may have many variations. FIG. 7 is a sectional view of a grip sleeve provided by a third preferred embodiment of the present invention. In this embodiment, though the grip sleeve 30 has a diameter L1 greater than that of the grip sleeve disclosed in FIGS. 2 and 6, the grip sleeve 30 has a plurality of non-contact portions 36, which are cylindrical recesses 362 on the inner periphery of the grip sleeve 30 and larger in size than those of the grip sleeve disclosed in the first and second preferred embodiments, to keep its weight substantially equal to that of the previously disclosed grip sleeve. FIG. 7 shows a sectional view of a grip sleeve provided by a fourth preferred embodiment of the present invention. In this embodiment, the non-contact portions 36 of the grip sleeve 30 are formed by a plurality cylindrical through holes 364 to enhance the elasticity and air permeability of the grip sleeve and to keep the weight of the grip sleeve equal to that of the grip sleeves disclosed in the former preferred embodiments.

In other word, the racket provided by the present invention allows the user to combine a grip sleeve having a specific size with the handle, such that the usage of the racket of the present invention is more flexible and the frequency of changing the whole racket can be minimized, thereby enhancing the reusability of the racket. In addition, by means of changing a new grip sleeve made from a different material, a different shock-absorbing effect or a different sense of touch can be provided. Further, the shock-absorbing effect can be increased by a cushion provided between the handle and the grip sleeve.

In the above-mentioned preferred embodiments, the racket is exemplified as a tennis racket. It will be however appreciated that the technical features disclosed by the present invention can be applied to badminton racket, squash racket and the like. Further, it should be understood that the detailed description and specific examples, while indicating preferred embodiments of the invention, are given by way of illustration only, and thus are not limitative of the present invention since various changes and modifications may be provided. For example, the number and location of the hole of the handle 24 including blind hole and through hole can vary. Similarly, the number and location of the cushions 60 and grooves 244 can vary provided that they are disposed between the handle 24 and the grip sleeve 30. Alternatively, the cushion 60 and the groove 244 can be eliminated. Further, the shape and construction of the non-contact portion 36 of the grip sleeve 30 can also vary. Such variations are not to be regarded as a departure from the spirit and scope of the invention, and all such modifications as would be obvious to one skilled in the art are intended to be included within the scope of the following claims.

What is claimed is:

1. A racket, comprising:

a main body having a frame, a handle, a bridge connected between the frame and the handle, and a hole at the handle;

a replaceable grip sleeve sleeved onto the handle and provided with at least one through hole aimed at the hole of the handle;

a nut having at least a part received in the hole of the handle; and a bolt having a shank inserted through the through hole of the replaceable grip sleeve and screwingly engaged with the nut, and a head located at an end of the shank and abutted against an outer periphery of the replaceable grip sleeve.

2. The racket of claim 1, wherein the hole of the handle penetrates the handle and the replaceable grip sleeve has two said through holes respectively aimed at two ends of the hole of the handle; the nut has a body inserted through the through hole of the replaceable grip sleeve and engaged with the bolt, and a head located at an end of the body of the nut and abutted against the outer periphery of the replaceable grip sleeve.

3. The racket of claim 1, wherein the hole of the handle is provided with a bottom.

4. The racket of claim 3, wherein a radial crosssection of the nut has a non-circular shape.

5. The racket of claim 1, further comprising at least one cushion disposed between the handle and the replaceable grip sleeve.

6. The racket of claim 5, wherein the handle is provided with at least one grove for accommodation of the at least one cushion.

7. The racket of claim 1, wherein an inner periphery of the replaceable grip sleeve is provided with at least one non-contact portion that is not contacted with the handle.

8. The racket of claim 7, wherein the non-contact portion is a recess.

9. The racket of claim 7, wherein the non-contact portion is a through hole.

* * * * *